US006099371A

United States Patent [19]

Nozawa et al.

[11] Patent Number: 6,099,371

[45] Date of Patent: Aug. 8, 2000

[54] COWLING FOR OUTBOARD MOTOR

[75] Inventors: Tomohiro Nozawa; Manabu Nakayama, both of Hamamatsu, Japan

[73] Assignee: Sanshin Kogyo Kabushiki Kaisha, Hamamatsu, Japan

[21] Appl. No.: 09/046,251

[22] Filed: Mar. 23, 1998

[30] Foreign Application Priority Data

Mar. 21, 1997 [JP] Japan ..... 9-085586

[51] Int. Cl.[7] ..... B63H 20/32

[52] U.S. Cl. ..... 440/77; 123/195 P

[58] Field of Search ..... 440/77; 123/195 P

[56] References Cited

U.S. PATENT DOCUMENTS 4,887,692 12/1989 Outani et al. .
4,967,704 11/1990 Imaeda .
5,488,939 2/1996 Nakai et al. .
5,713,772 2/1998 Takahashi et al. .
5,928,043 7/1999 Rinzaki ..... 440/77

*Primary Examiner*—Sherman Basinger
*Attorney, Agent, or Firm*—Knobbe, Martens, Olson & Bear LLP

[57] ABSTRACT

A cowling arrangement for an outboard motor for use in powering a watercraft is disclosed. The motor has an engine and a water propulsion device, the engine having an output shaft arranged to drive the water propulsion device. The cowling defines an engine compartment in which the engine is positioned and an air chamber having an inlet. The cowling comprises a cover and an air chamber base. The air chamber base is connected to the cover in a sealed manner and divides the engine compartment from the air chamber and includes a duct which extends upwardly into the air chamber. The air chamber base which defines an air passage leading from the chamber to the engine compartment. The air chamber base defines a surface sloping in a direction of a drain through the air chamber, whereby water drawn through the inlet is drained therefrom.

17 Claims, 11 Drawing Sheets

COWLING FOR OUTBOARD MOTOR

FIELD OF THE INVENTION

The present invention relates to an outboard motor. More particularly, the invention is a cowling arrangement for such a motor.

BACKGROUND OF THE INVENTION

Watercraft are often powered by an outboard motor positioned at a stern of the craft. The outboard motor has a powerhead and a water propulsion device, such as a propeller. The powerhead includes a cowling in which is positioned an internal combustion engine, the engine having an output shaft arranged to drive the water propulsion device.

Referring to FIGS. 14 and 15, traditionally the cowling 200 comprises a multi-part cover comprising an engine compartment cover 202 and an air chamber cover 204. The engine compartment cover 202 defines an enclosed engine compartment 206 in which the engine is positioned.

The engine compartment cover 202 has open top section in which is positioned a base member. This base member includes an upstanding wall 208 and a flat bottom wall 210. The air chamber cover 204 is connected to the engine compartment cover 202 and extends from the upstanding wall 208 of the base member over the flat bottom wall 210, and cooperates therewith to define an air inlet chamber 212. A gap is provided between the air chamber cover 204 and engine compartment cover 202 at a rear end of the motor, thereby defining an air inlet 214.

An air duct 216 extends upwardly from the flat bottom wall 210 into the air chamber 212. This duct 216 has a passage therethrough leading from the chamber 212 into the engine compartment 206. In this arrangement, air A flows through the inlet 214 into the air chamber 212 and then through the duct 216 to the engine compartment 206.

While this cowling arrangement provides for convenient manufacture in that the individual components of the cowling 200 are relatively easily assembled, the arrangement has several drawbacks.

First, the air chamber cover 204, which is a separate element from the engine compartment cowling 202, is exposed to the outside of the cowling 200. At the attachment of the air chamber cover 204 to the engine compartment cowling 202, there is often an unsightly gap. In addition, during the manufacturing process the air chamber cover 204 and engine compartment cowling 202 are often formed in separate steps, such that they end up somewhat different in exterior color, making the cowling 200 unattractive.

A more serious problem is illustrated in FIG. 15. As illustrated, the upstanding air duct 216 is used to reduce the flow of water into the engine compartment 206, it being desired that the water collect onto the flat bottom 210 and then drain from the cowling 200. The problem is that water often collects on the bottom 210 and does not drain therefrom at a fast enough rate. This water W may then flow through the gaps at the intersection of the upstanding wall 208 and flat bottom 210 where the base member attaches to the engine compartment cowling 202.

An improved cowling arrangement for an outboard motor which overcomes the above-stated problems is desired.

SUMMARY OF THE INVENTION

The present invention is a cowling arrangement for an outboard motor for use in powering a watercraft. The motor has an engine and a water propulsion device, the engine having an output shaft arranged to drive the water propulsion device.

The cowling defines an engine compartment in which the engine is positioned and an air chamber having an inlet. The cowling comprises an engine compartment cover, an air chamber cover and an air chamber base, the engine compartment cover and air chamber cover integrally formed.

The air chamber base is connected to the engine compartment cover in a sealed manner and divides the engine compartment from the air chamber and includes a duct which extends upwardly into the air chamber and which defines an air passage leading from the chamber to the engine compartment. The air chamber base defines a surface sloping in a direction of the air chamber towards a drain, whereby water drawn through the inlet is quickly drained from the air chamber.

Preferably, a peripheral edge of the air chamber base includes a groove. A rib connected to the engine compartment cover extends into the groove. A space between the rib and air chamber base at the groove is sealed with a seal.

Further objects, features, and advantages of the present invention over the prior art will become apparent from the detailed description of the drawings which follows, when considered with the attached figures.

DETAILED DESCRIPTION OF THE PREFERRED EMBODIMENTS OF THE INVENTION

Figure 1:
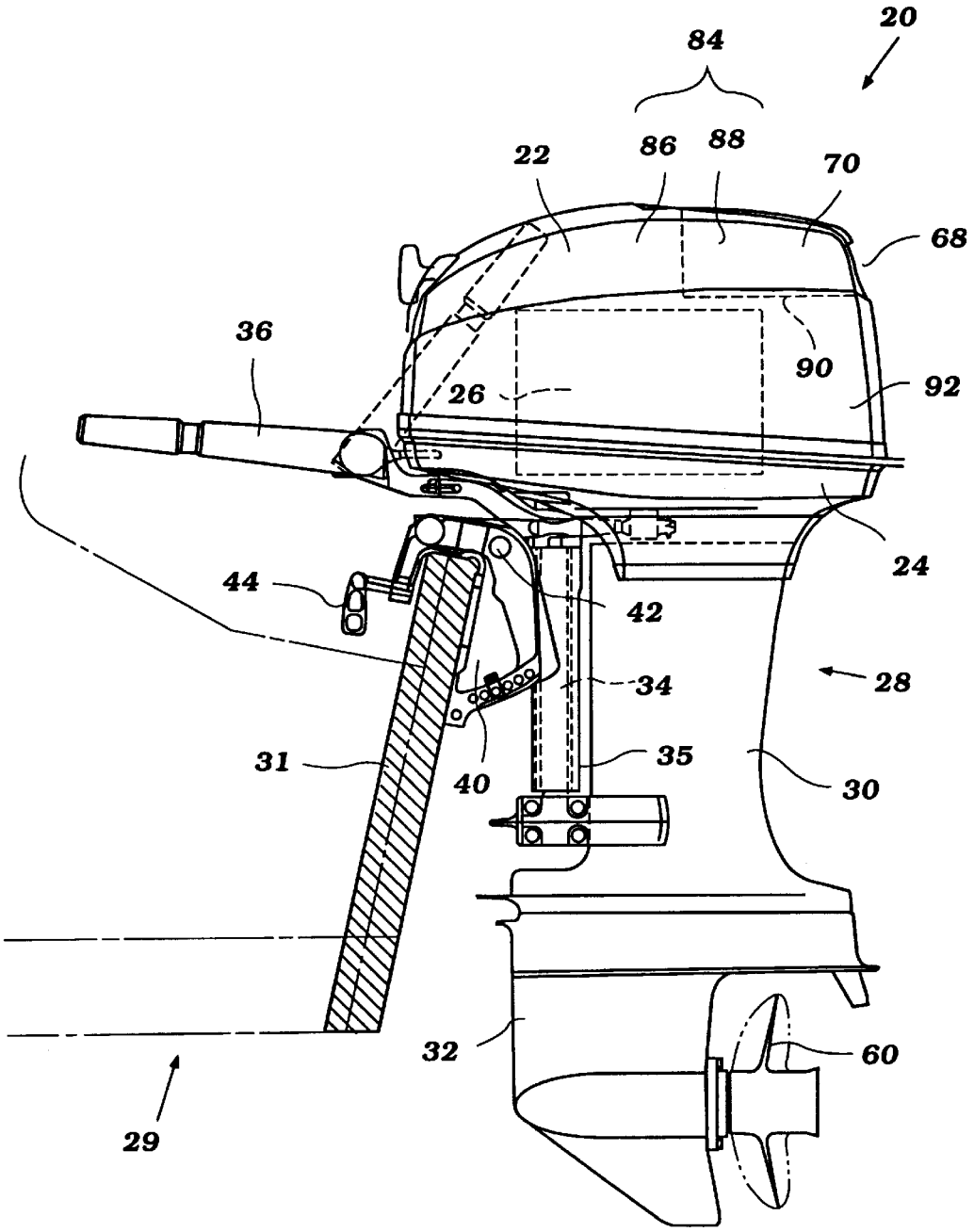
FIG. 1 is a side view of an outboard motor used to power a watercraft, the motor powered by an engine positioned in a cowling arranged in accordance with the present invention.

FIG. 1 illustrates an outboard motor 20 of the type with which the present invention is useful. The outboard motor 20 has a powerhead comprising a main cowling 22 with a lower cowling or tray 24 positioned therebelow. An internal combustion engine 26 is positioned in the powerhead.

A drive shaft housing or lower unit 28 depends below the powerhead. The drive shaft housing 28 comprises an upper casing 30 and a lower casing 32 positioned below the upper casing.

The outboard motor 20 is arranged to be movably connected to a hull of a watercraft 29, preferably at a transom 31 of the watercraft at a stem thereof. In this regard, a steering or pivot shaft 34 is connected to the motor 20. The steering shaft 34 preferably extends along a vertically extending axis through a swivel bracket 35. The mounting of the steering shaft 34 with respect to the swivel bracket 35 permits rotation of the motor 20 about the vertical axis through the bracket 35, so that the motor may be turned from side to side.

A steering handle 36 is connected to the bracket 35. An operator of the motor 20 may move the outboard motor 20 from side to side with the handle 36, thus steering the watercraft to which the motor is connected.

The swivel bracket 34 is connected to a clamping bracket 40 by means of a pivot pin 42 which extends along a generally horizontal axis. The clamping bracket 40 is arranged to be removably connected to the hull of a watercraft with a clamping screw 44 or similar mechanism. The mounting of the motor 20 with respect to the clamping bracket 40 about the pin 42 permits the motor 20 to be raised up and down or "trimmed."

Figure 2:
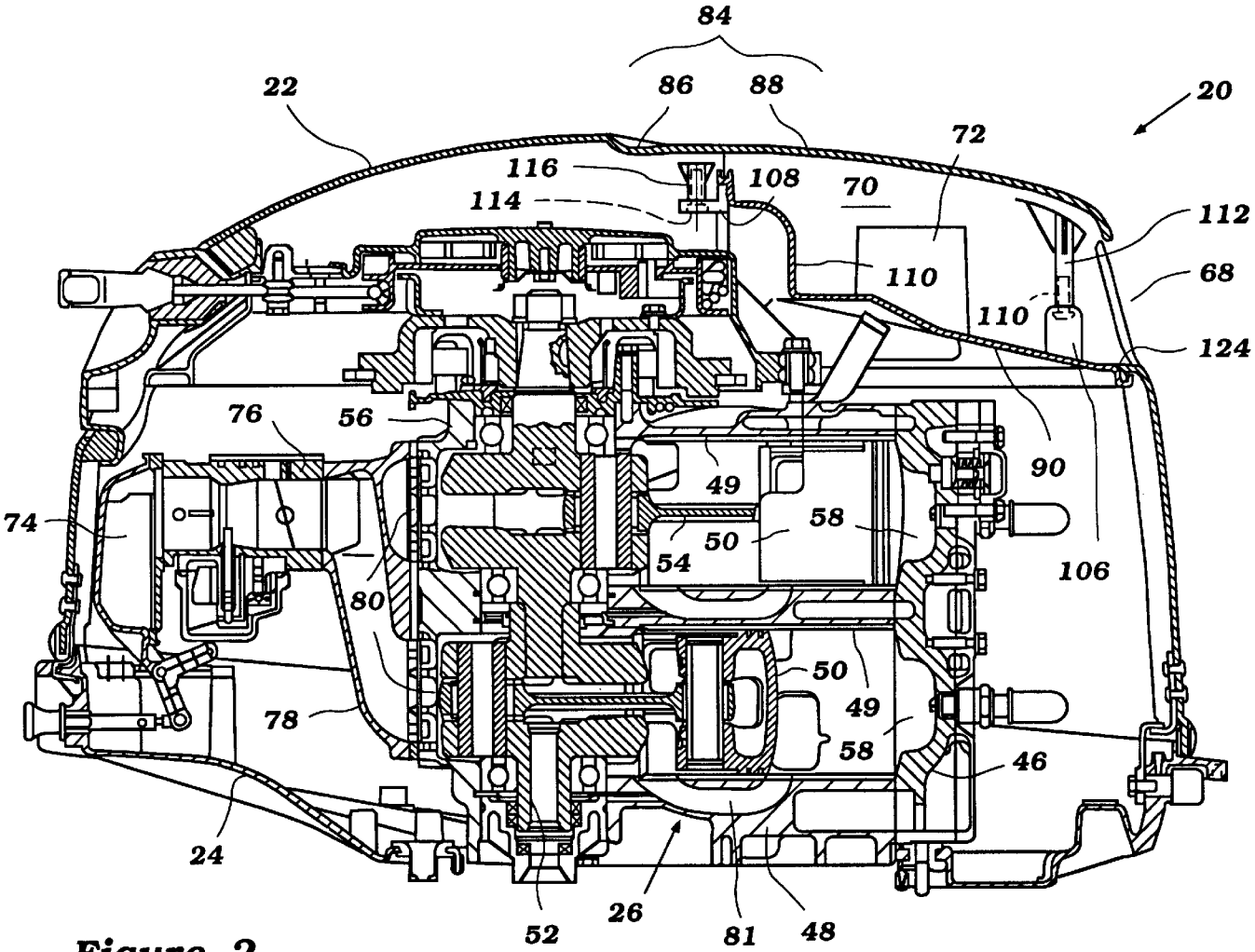
FIG. 2 is a cross-sectional side view of a powerhead portion of the motor illustrated FIG. 1.

As described above, an engine 26 is positioned in the powerhead. Referring to FIG. 2, the engine 26 is preferably of the two-cylinder variety, arranged in in-line fashion and operating on a two-cycle principle. As may be appreciated by those skilled in the art, the engine 26 may have a greater or lesser number of cylinders, may be arranged in other than in-line fashion and may operate on other operating principles, such as a four-cycle principle.

The engine 26 preferably comprises a cylinder head 46 connected to a cylinder block 48 and cooperating therewith to define two cylinders 49 each having a combustion chamber 58. A piston 50 is movably positioned in each cylinder 48 and connected to a crankshaft 52 via a connecting rod 54.

As best illustrated in FIG. 2, the crankshaft 52 is generally vertically extending. As such, the cylinders 49, and thus the pistons 48, extend in a horizontal direction. The crankshaft 52 is mounted for rotation with respect to the remainder of the engine 26 within a crankcase chamber defined by the cylinder block 48 and a crankcase cover 56 connected thereto. As illustrated, the crankcase cover 56 is positioned at the opposite end of the cylinder block 48 from the cylinder head 46. Preferably, the cylinder head end of the engine 26 is positioned within the main cowling 22 farthest from a watercraft when the motor 20 is attached thereto, and the crankcase end of the engine 26 is thus closest to a watercraft when the motor 20 is attached thereto.

The crankshaft 52 extends below a bottom of the engine 26 in the direction of the drive shaft housing 28, where it is coupled to a drive shaft (not shown). The drive shaft extends through the drive shaft housing 28 and is arranged to drive a water propulsion device of the motor 20. As illustrated, the water propulsion device is a propeller 60. The drive shaft is preferably arranged to drive the propeller 60 through an appropriate transmission, as well known to those of skill in the art.

An intake system provides air to each cylinder of the engine 26 for the combustion process. As illustrated in FIG. 2, air is drawn through an inlet 68 through the main cowling 22 into an air chamber 70. Air then flows through one of two upwardly extending air inlet pipes or ducts 72,73 (see also FIG. 3) into the interior of the cowling in which the engine 26 is positioned. The particular construction of this portion of the intake system will be described in much greater detail below.

Figure 4:
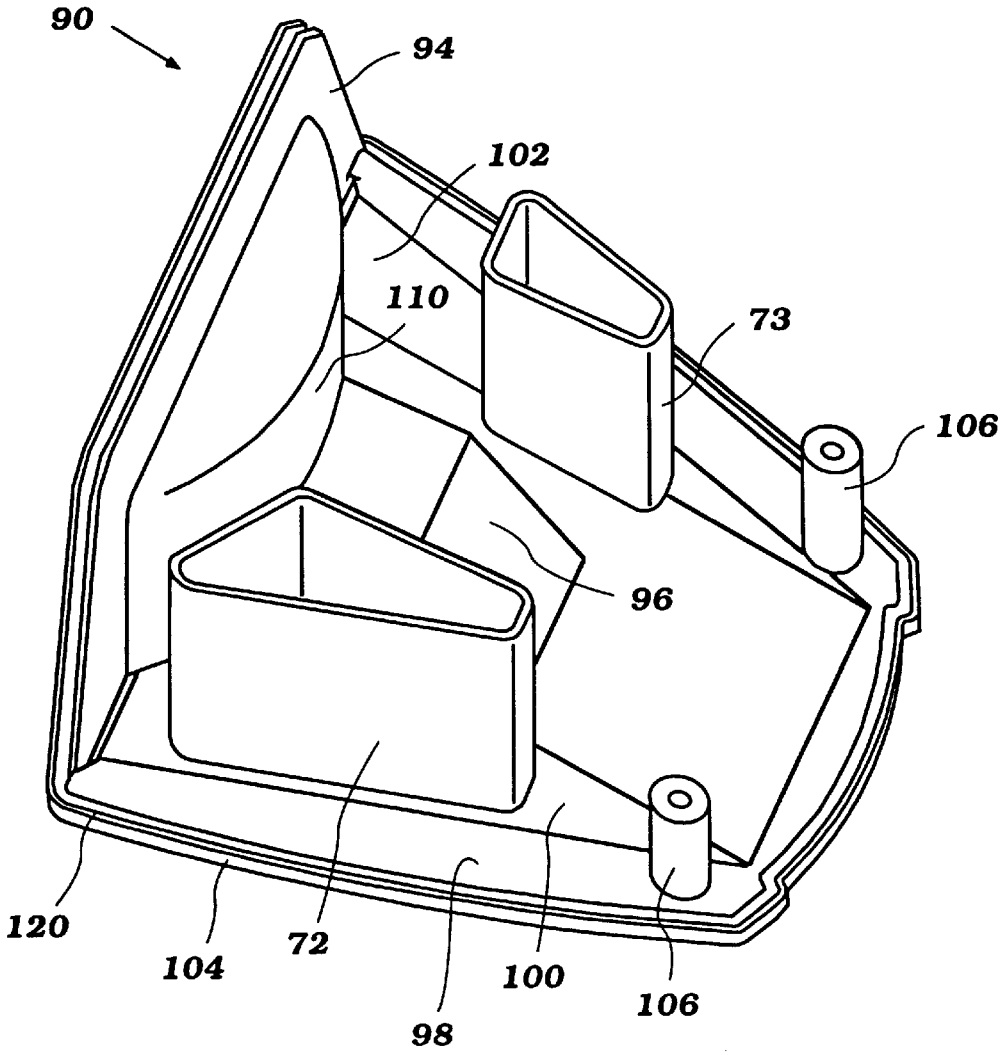
FIG. 4 is a perspective view of an air chamber base member of the cowling of the motor illustrated in FIG. 1.
Figure 5:
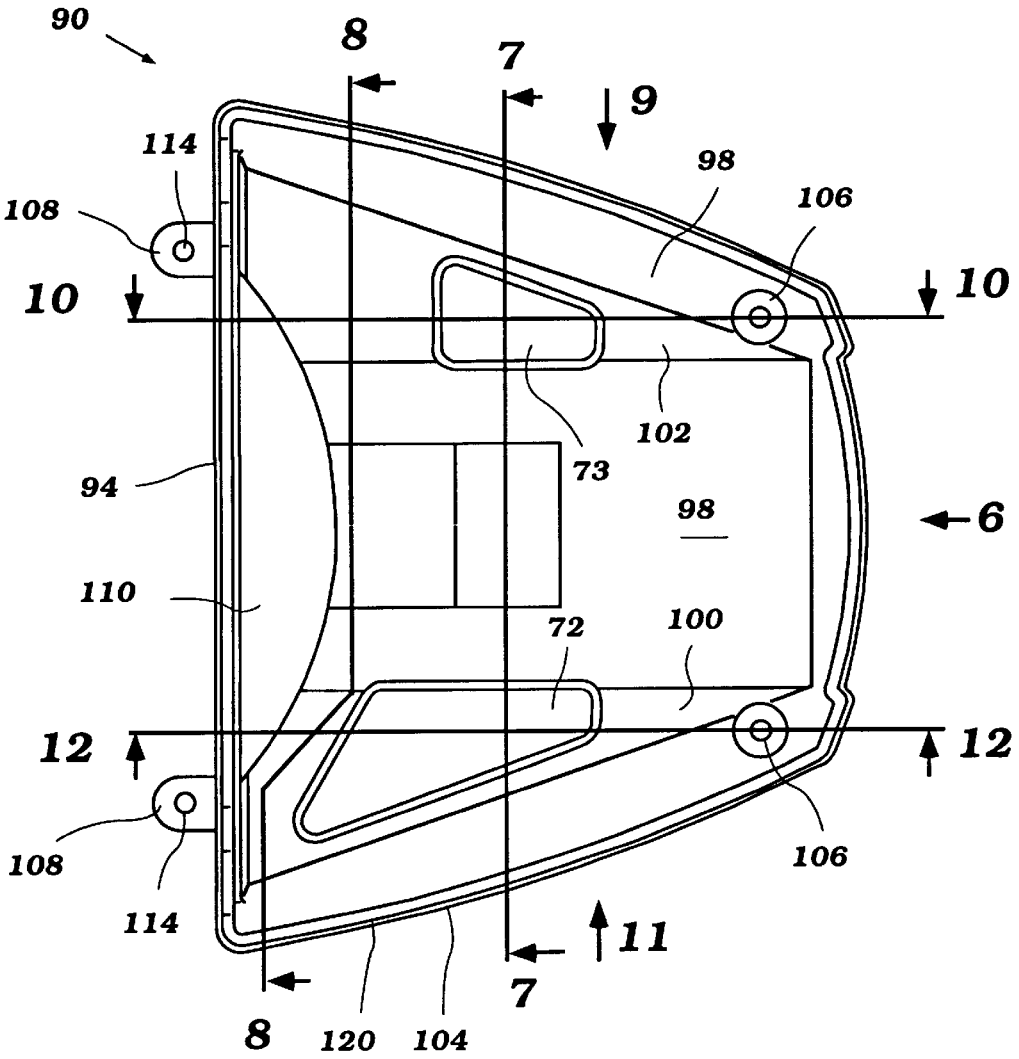
FIG. 5 is a top view of the air chamber base member illustrated in FIG. 4.
Figure 6:
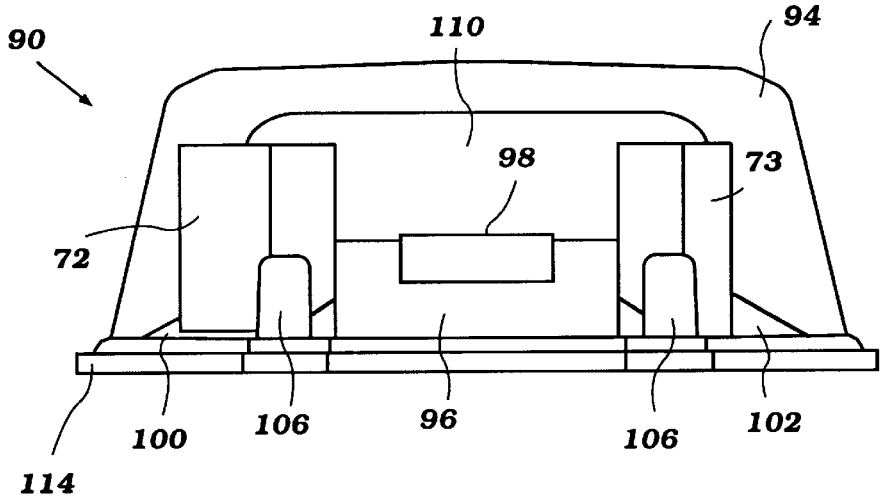
FIG. 6 is a view of the air chamber base member taken in the direction of arrow 6 in FIG. 5.
Figure 7:
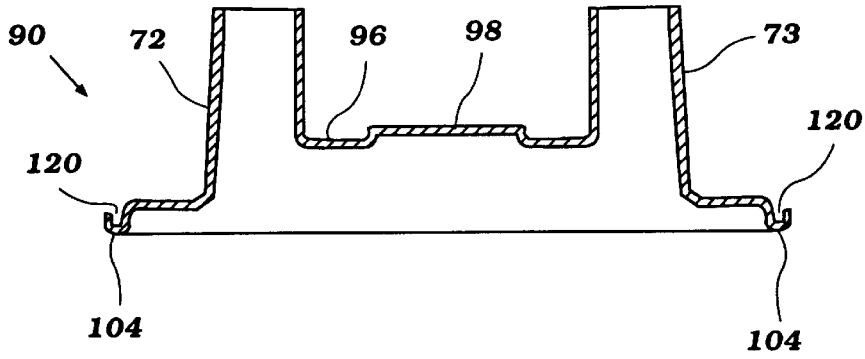
FIG. 7 is a cross-sectional view of the air chamber base member taken along line 7—7 in FIG. 5.
Figure 8:
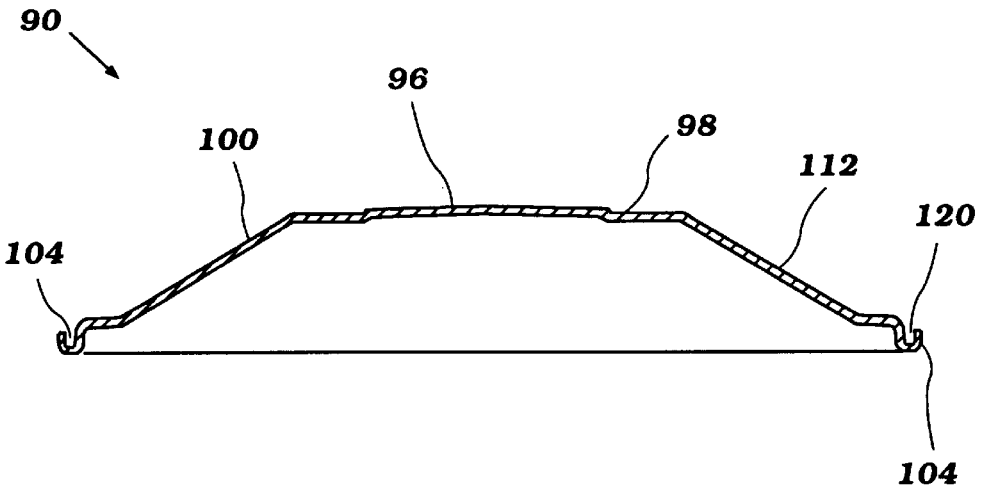
FIG. 8 is a cross-sectional view of the air chamber base member taken along line 8—8 in FIG. 5.
Figure 9:
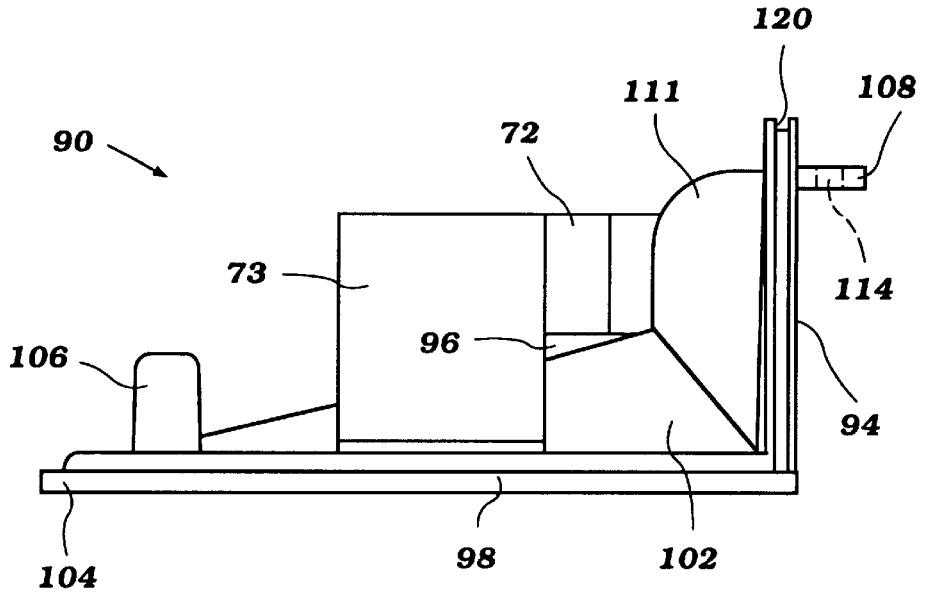
FIG. 9 is a view of the air chamber base member taken in the direction of arrow 9 in FIG. 5.
Figure 10:
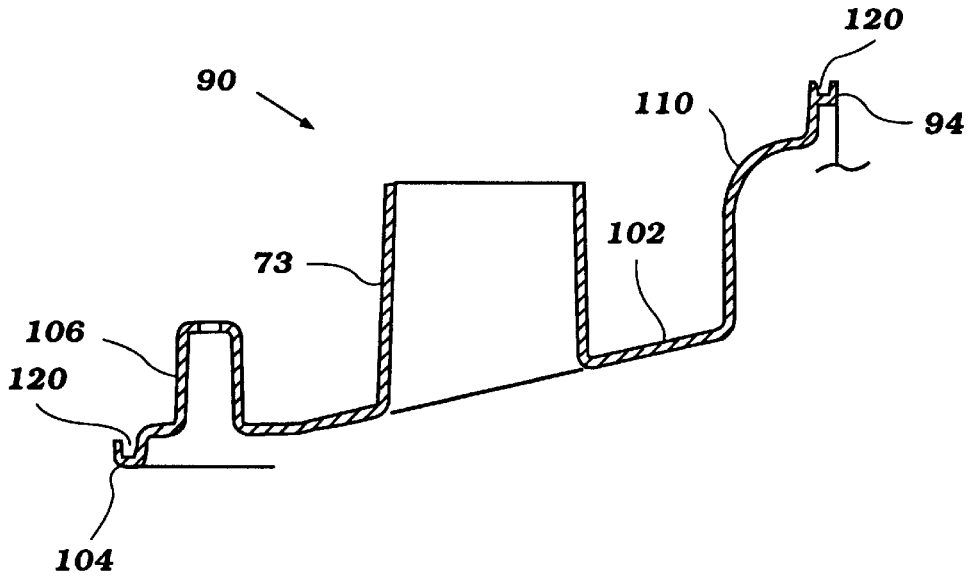
FIG. 10 is a cross-sectional view of the air chamber base member taken along line 10—10 in FIG. 5.
Figure 11:
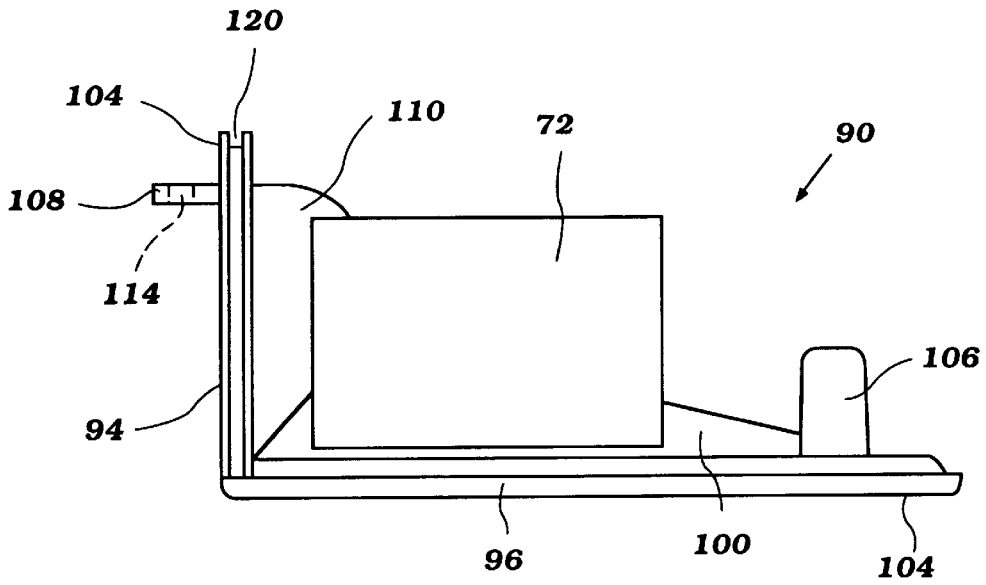
FIG. 11 is a view of the air chamber base member taken in the direction of arrow 11 in FIG. 5.
Figure 12:
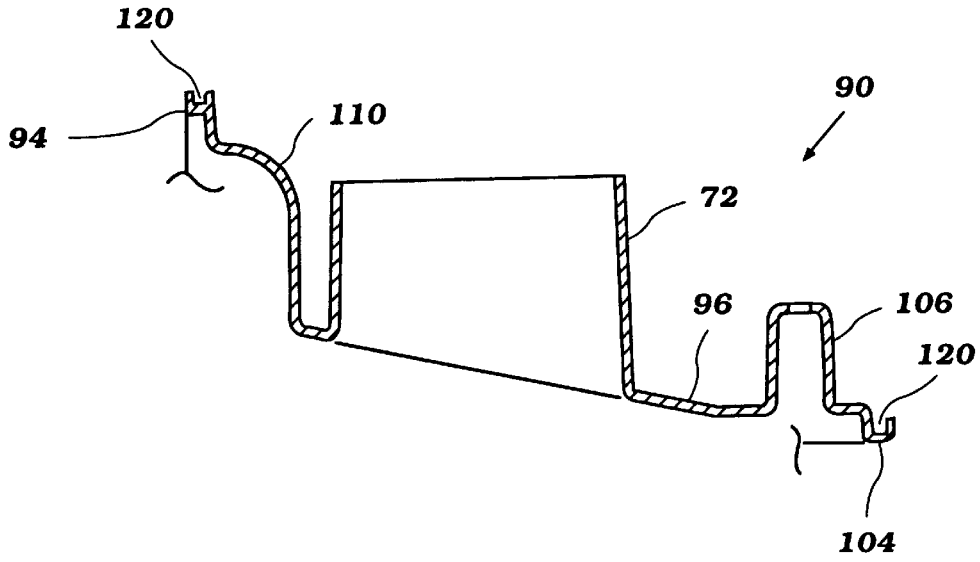
FIG. 12 is a cross-sectional view of the air chamber base member taken along line 12—12 in FIG. 5.

Air within the main cowling 22 is drawn through a pair of inlet ports 75 into a silencer 74 (see FIG. 4). The air is then drawn from the silencer 74 through a carburetor 76 to a pair of branch pipes 78. The branch pipes 78 are connected to the crankcase cover 56 of the engine 26 and each have a passage therethrough leading to the crankcase chamber. A reed valve 80 controls the flow of air (and fuel) from the passage through the branch pipe 78 into the crankcase chamber.

As is well known in the art of two-cycle engines, the crankcase chamber is divided into individual chambers corresponding to each cylinder 49. An air and fuel mixture flows into each individual chamber as controlled by the reed valve 80 when the piston 50 corresponding to that cylinder 49 moves upwardly. The piston 50 serves to compress the air and fuel mixture in the crankcase chamber (the reed valve 80 preventing backflow into the branch pipe 78), with the partially compressed air and fuel mixture then flowing through one or more scavenge passages 81 into the cylinder 49. This mixture is then combusted, driving the piston 50 downwardly and rotating the crankshaft 52.

Although such does not form a portion of the present invention, a throttle valve and choke valve may be provided for controlling the flow rate of air through the intake system.

A fuel system provides fuel to each cylinder for combustion with the air. The fuel system draws fuel from a fuel supply (not shown) such as a fuel tank positioned in the hull of the watercraft to which the motor 20 is connected. The fuel is delivered to the carburetor 76, which introduces fuel into the air passing therethrough.

The engine 26 includes an ignition system. Such systems are well known to those of skill in the art, and thus the system is not described in detail herein. Preferably, however, the system includes a powered ignition coil which delivers a charge at a predetermined time to a spark plug corresponding to each cylinder. Each spark plug has its tip positioned in the cylinder, and when the charge is delivered to the spark plug, effects a spark across an electrode tip thereof to initiate the combustion of the air and fuel mixture in the cylinder.

A suitable exhaust system is provided for routing exhaust from each cylinder 49. Preferably, an exhaust passage (not shown) leads through the cylinder head 46 from each cylinder 49, with a portion of the exhaust system then routing this exhaust to an appropriate above or below the water discharge from the motor 20.

The particular cowling arrangement in accordance with the present invention will now be described in detail. Referring to FIG. 1, the main cowling 22 is defined by a cover 84 comprising an engine compartment cover 86 and an air chamber cover 88. In the preferred embodiment, the engine compartment cover 86 and air chamber cover 88 are integrally formed, so that there is no gap therebetween, such as from a single sheet of aluminum.

The engine compartment cover 86 does not define a contiguous surface in the area of the air chamber 70. An air chamber base member 90 is connected to the engine compartment cover 86 and occupies the discontinuity in the engine compartment cover 86. The engine compartment cover 86 and connected air chamber base member 90 define an enclosed engine compartment 92 in which the engine 26 is positioned. At the same time, the air chamber cover 88 extends over an open top of the air chamber base member 90 to define the air chamber 70 and air inlet 68.

In accordance with the present invention, the air chamber base member 90 is designed to cooperate with the engine compartment cover 86 and air chamber cover 88 to prevent water from entering the engine compartment 92, permit water which is drawn into the air chamber 70 to drain from the motor 20 and to provide a motor 20 with an appealing outer appearance.

The air chamber base member 90 will now be described in detail with reference to FIGS. 4–12. As illustrated, the member 90 has a forward wall 94 and a bottom wall 96. At least a portion of the forward wall 94 extends generally vertically upward with respect to a portion of the bottom wall 96.

Figure 3:
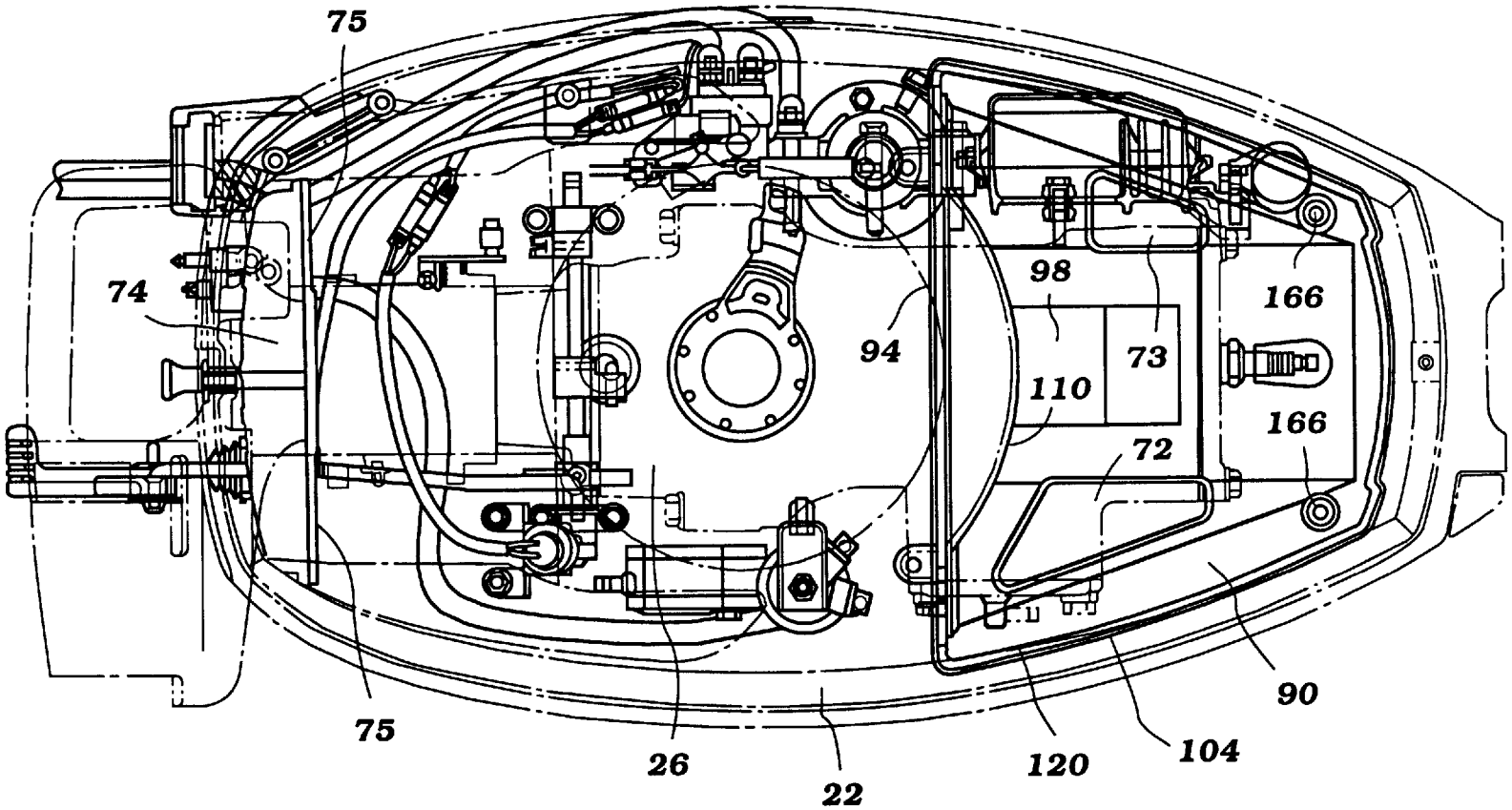
FIG. 3 is a top view of the motor illustrated in FIG. 3, with a top part of the cowling thereof illustrated in phantom to expose the engine therein.

As may be best seen in FIGS. 2 and 3, the cover member 22 has an inverted cup shape with a lower open end. The air chamber base member 90 has a configuration so that it can be inserted through this open end for assembly purposes.

The member 90 has a peripheral edge 104 defining the edge of the bottom wall 96 and forward wall 94. The bottom wall 96 has first and second side portions 100,102, and a center section 98 between the first and second side portions 100,102. The bottom wall 96 is generally "U"-shaped when viewed from above (see FIG. 5). The peripheral edge 104 preferably lies substantially in a horizontal plane (see FIG. 6). At the intersection of the forward wall 94 and bottom wall 96, the peripheral edge 104 turns at approximately 90 degrees, extending upwardly to define the forward wall.

A pair of mounting bosses 106 extend upwardly from the bottom wall 96 near a rear edge (i.e. opposite the forward wall 94). As illustrated in FIG. 2, a fastener 110 is arranged to mount to the boss 106 and engage a mounting part 112 of the air chamber cover 88. Preferably, the fastener 110 is a threaded fastener having a portion which extends upwardly through a hole in a top part of the boss 106 into the mounting part 112 of the air chamber cover 88, this mounting part 112 extending downwardly from the cover 88 towards the boss 106. In this fashion, the air chamber cover 88 and air chamber base member 90 are securely connected.

Likewise, a pair of mounting brackets 108 extend outwardly from the forward wall 94 in a direction generally opposite the bottom wall 96. The brackets 108 are mounted near the top of the wall 94 and each have a hole or passage 114 therethrough. A portion of a fastener is arranged to pass through the passage 114 and engage a corresponding mounting part 116 extending downwardly from the engine compartment cover 86.

Generally, the center section 98 of the bottom wall 96 slopes upwardly moving in the direction of the rear edge towards the forward wall 94 (see FIG. 2). At the same time, the first and second sides 100,102 slope away from the center section 98 downwardly towards the generally flat peripheral edge 104 (see FIG. 8).

The air ducts 72,73 extend upwardly from the bottom wall 96. In the embodiment illustrated, a primary or main air duct 72 extends upwardly from the first side 100 of the bottom wall 96, while a smaller or secondary air duct 73 extends upwardly from the second side 102 of the bottom wall 96. Each air duct 72,73 comprises an upstanding wall portion of the bottom wall 96 which defines a passage through the bottom wall 96. The ducts 72,73 are spaced, with the sloping center section 98 positioned therebetween.

While the periphery of the forward wall 94 extends upwardly generally perpendicular to the periphery of the bottom wall 96, a center portion of the wall defines a protruded part 110 which does not lie in the same vertical plane as the periphery of the wall. This protruded part 110 is a convex portion of the forward wall 94 which faces outwardly in the direction of the bottom wall 96.

Figure 13:
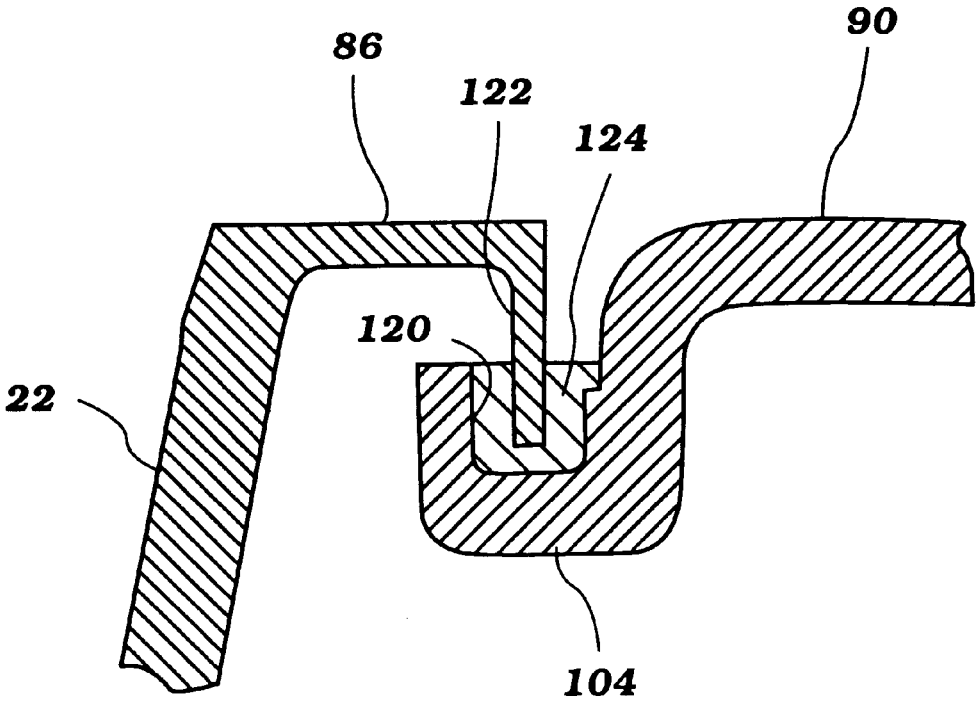
FIG. 13 is an enlarged cross-sectional view of an interface of the air chamber base member and an engine compartment cover of the cowling of the motor illustrated in FIG. 1.
Figure 14:
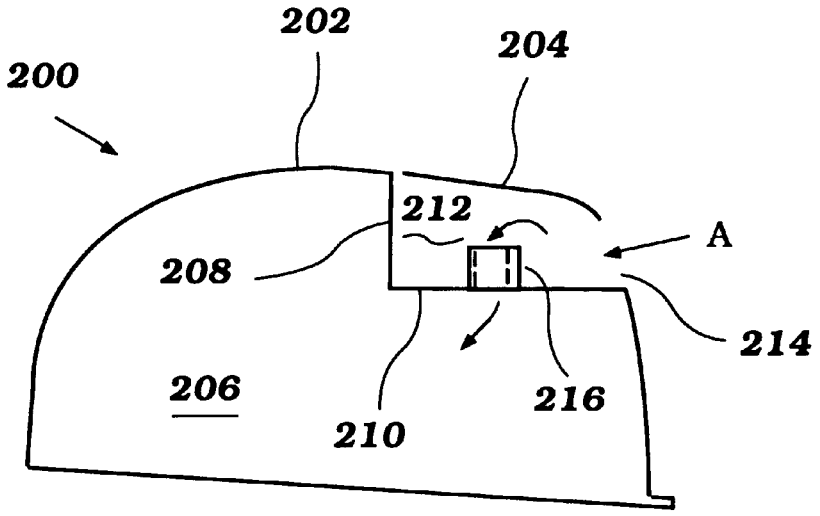
Figure 14 (Prior Art)
FIG. 14 is a side view of an outboard motor having a cowling in accordance with the present invention.
Figure 15:
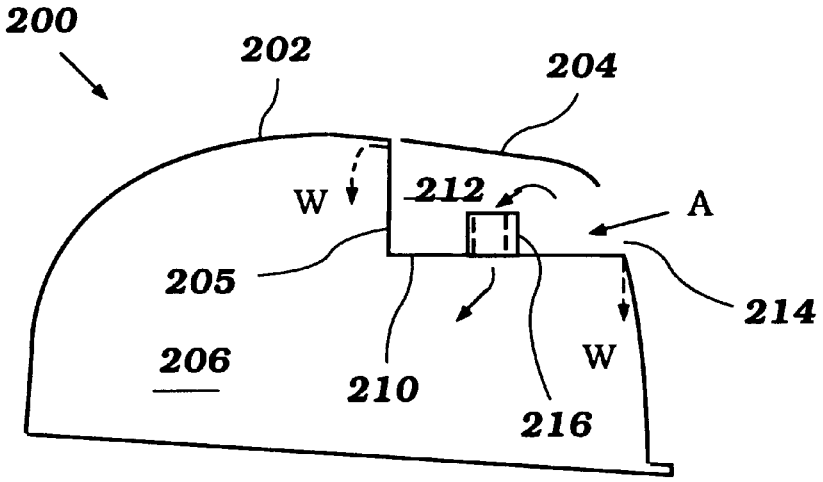
Figure 15 (Prior Art)
FIG. 15 is another side view of an outboard motor having a cowling in accordance with the present invention.

Referring to FIGS. 2, 4 and 13, a groove 120 is provided in the peripheral edge 104 of the air chamber base member 90. The groove 120 is a trough which faces upwardly along the entirety of the periphery 104 of the base member 90.

The groove 120 facilitates the interengagement of the air chamber base member 90 to the remainder of the cover 84 in a sealed fashion. As illustrated in FIGS. 2 and 13, a rib 122 extends inwardly from the engine compartment cover 86. This rib 122 is adapted to fit within the portion of the groove 120 of the forward wall 94. This rib 122 engages the entire length of the groove 120 which is defined in the peripheral edge 104 of the base member 90.

A seal element 124 seals the interengaging rib 122 and groove 120. The seal 124 may comprise a sealing agent which is applied into the groove 120, with the base section 90 then positioned so that the rib 122 or other interengaging element on the engine compartment cover 86 extends into the agent, with the sealing agent sealing against the rib 122. Of course, other means for sealing may be used, such as a rubber seal or the like.

In accordance with the present invention, air is drawn through the inlet 68 into the air chamber 70. The air then flows through one of the two ducts 72,73 into the engine compartment 92 to the intake system.

The air which flows into the air chamber 70 contains water, while the air which flows through the ducts 72,73 contains little water. This water is removed in the air chamber 70.

Advantageously, the sloped surface of the front wall 94 and bottom 96 cause this water to flow from the chamber 70 through the inlet 68 out of the motor 20. Because of the sloping surface of the base section 90, the water does not pool or stagnate in the chamber 70, and instead relatively quickly flows therefrom to a point external to the motor 20.

Those of skill in the art will appreciate that the air chamber base member 90 may be arranged so that its surfaces slope in a variety of other directions and to a water drain which is other than the inlet to the chamber. For example, the left and right sides of the bottom of the member 90 might slope inwardly in "V" fashion to a central trough, with this trough leading to a drain. The drain might also comprise a separate passage provided through the cowling 22 instead of the inlet 68.

Another advantage of the invention is that the cover 84 is constructed in a water-tight manner which prevents that water which is in the air chamber 70 from flowing into the engine compartment 92 at the interface between the air chamber base member 90 and the engine compartment cover 86. In particular, the base member 90 and engine compartment cover 86 interlock in a sealed fashion.

Also, the engine compartment cover 86 and air chamber cover 86 are formed from a single member, such that there is no unsightly gap therebetween on the external surface. This arrangement also makes more simple the task of painting the cover 84 or the like so that the exterior thereof has a uniform appearance.

While a preferred arrangement has been described for coupling the air chamber covers 88 and engine compartment cover 86 to the air chamber base member 90 (i.e., threaded fasteners), those of skill in the art will appreciate that a variety of means for connecting may be used, such as straps, adhesives and the like.

In addition, as such does not form a portion of the invention, a variety of details of the motor and engine have not been described. Those of skill in the art will appreciate the particulars of these components.

While the air chamber base member 90 has been described as defining two ducts 72, 73, those of skill in the art will appreciate that there may only be provided one duct, or there may be provided more than two ducts.

Of course, the foregoing description is that of preferred embodiments of the invention, and various changes and modifications may be made without departing from the spirit and scope of the invention, as defined by the appended claims.

What is claimed is:

1. A cowling for an outboard motor for use in powering a watercraft, said motor having an engine and a water propulsion device, said engine having an output shaft arranged to drive said water propulsion device, said cowling defining an engine compartment in which said engine is positioned and an air chamber having an inlet, said cowling comprising an integral single piece cover having a generally inverted cup shape formed as a unit without joined sections and defining in major part said engine compartment, said cover defining said inlet for receiving atmospheric air, said cowling further including an air chamber base, said air chamber base being sized to be capable of insertion through a lower opening formed by said cup shape of said cover and being detachably connected to said cover in proximity to said inlet for defining with said cover said air chamber, said air chamber base having a peripheral edge extending around its entire periphery and sealingly engaging said cover for completely dividing said engine compartment from said air chamber, said air chamber base including a duct means formed by portions thereof spaced inwardly from said peripheral edge and extending upwardly into said air chamber and surrounding at least one vertically extending passage therethrough leading from an inlet opening formed at an upper end of said vertically extending passage and forming the only path of air flow from said inlet to said engine compartment.

2. The cowling in accordance with claim 1, wherein said cowling has an upper portion and said cover forms substantially the entire exterior surface of the upper portion of said cowling arrangement.

3. The cowling in accordance with claim 2, wherein said air chamber base defines a surface sloping in a direction of a drain from said air chamber, whereby water drawn through said inlet is drained therefrom.

4. The cowling in accordance with claim 3, wherein said drain comprises said air inlet.

5. The cowling in accordance with claim 3, wherein said surface of said air chamber base slopes from a center section downwardly to each side.

6. The cowling in accordance with claim 3, wherein said inlet is provided at a rear of said cowling and said surface of said air chamber base slopes towards said rear of said cowling.

7. The cowling in accordance with claim 1, wherein said duct means comprises a pair of ducts extend upwardly from said air chamber base into said air chamber, each duct defining an air passage therethrough leading from said air chamber to said engine compartment.

8. The cowling in accordance with claim 1, wherein said air chamber base has a bottom and a forward wall, said forward wall forming a part of said peripheral edge extending upwardly generally perpendicular to at least a portion of said bottom.

9. A cowling for an outboard motor for use in powering a watercraft, said motor having an engine and a water propulsion device, said engine having an output shaft arranged to drive said water propulsion device, said cowling defining an engine compartment in which said engine is positioned and an air chamber having an inlet and at least one duct leading into said engine compartment, said cowling comprising a cover and an air chamber base, said air chamber base connected to said cover and dividing said engine compartment from said air chamber, said duct leading through said air chamber base, said air chamber base having a groove positioned along a peripheral edge thereof and a rib extending from said cover into said groove, and a seal positioned in said groove and sealing a space between said rib and said air chamber base in said groove.

10. The cowling in accordance with claim 9, wherein said cover comprises an engine compartment cover and air chamber cover.

11. The cowling in accordance with claim 10, wherein said engine compartment cover and air chamber cover are integrally formed.

12. The cowling in accordance with claims 10, wherein said air chamber base is connected to said engine compartment cover and said air chamber cover extends over said air chamber base.

13. The cowling in accordance with claim 9, wherein said air chamber base defines a bottom surface, said surface sloping through said air chamber to a drain.

14. The cowling in accordance with claim 13, wherein said drain comprises said inlet.

15. The cowling in accordance with claim 9, wherein said air chamber base has a bottom wall and an upstanding front wall.

16. The cowling in accordance with claim 15, wherein said front wall includes a surface protruding outwardly in a direction of said bottom wall.

17. The cowling in accordance with claim 9, wherein said air chamber base defines two ducts.

* * * * *